US011072477B2

(12) United States Patent
Covi

(10) Patent No.: US 11,072,477 B2
(45) Date of Patent: Jul. 27, 2021

(54) CLOSING DEVICE, VALVE UNIT AND CONTAINER

(71) Applicant: Emanuela Covi, Merano (IT)

(72) Inventor: Emanuela Covi, Merano (IT)

( * ) Notice: Subject to any disclaimer, the term of this patent is extended or adjusted under 35 U.S.C. 154(b) by 0 days.

(21) Appl. No.: 16/619,747

(22) PCT Filed: Jun. 5, 2018

(86) PCT No.: PCT/IT2018/050103
§ 371 (c)(1),
(2) Date: Dec. 5, 2019

(87) PCT Pub. No.: WO2018/225110
PCT Pub. Date: Dec. 13, 2018

(65) Prior Publication Data

US 2020/0095045 A1 Mar. 26, 2020

(30) Foreign Application Priority Data

Jun. 6, 2017 (IT) ..... 102017000061470

(51) Int. Cl.
*B67D 3/00* (2006.01)
*B65D 77/06* (2006.01)
*B67D 1/04* (2006.01)
*B67D 1/08* (2006.01)

(52) U.S. Cl.
CPC ..... *B65D 77/067* (2013.01); *B67D 1/0462* (2013.01); *B67D 1/0801* (2013.01); *B67D 1/0835* (2013.01); *B67D 2001/0827* (2013.01)

(58) Field of Classification Search
CPC .... B65D 77/067; B65D 77/06; B67D 1/0462; B67D 1/0801; B67D 1/0835; B67D 2001/0827
See application file for complete search history.

(56) References Cited

U.S. PATENT DOCUMENTS 4,286,636 A * 9/1981 Credle ..... B67D 1/0835 141/114
7,546,935 B2 * 6/2009 Wheaton ..... B67D 1/0832 137/212
8,083,107 B2 * 12/2011 Laible ..... B65D 47/283 222/478
8,820,587 B2 * 9/2014 Imai ..... B67D 1/0829 222/394

(Continued)

FOREIGN PATENT DOCUMENTS

WO 00/03944 A1 1/2000
WO 2012/167333 A1 12/2012

OTHER PUBLICATIONS

Search Report and Written Opinion for International Application No. PCT/IT2018/050103 dated Aug. 7, 2018.

*Primary Examiner* — Donnell A Long
(74) *Attorney, Agent, or Firm* — Calfee Halter & Griswold LLP

(57) ABSTRACT

A closing device is described for a container for fluids, comprising a valve unit provided with a passage aperture for the fluid and a body, wherein the body comprises shutter means and is mobile with respect to the passage aperture to alternatively define at least a closed configuration in which the shutter means close the passage aperture, and an open configuration in which the shutter means are distanced from the passage aperture.

11 Claims, 2 Drawing Sheets

(56) References Cited

U.S. PATENT DOCUMENTS

| | | | | |
|---|---|---|---|---|
| 9,242,847 | B1 * | 1/2016 | Laible | B67D 7/0294 |
| 2009/0320264 | A1 * | 12/2009 | Berger | B29C 66/114 29/428 |
| 2011/0017737 | A1 * | 1/2011 | Apps | B65D 11/08 220/254.1 |
| 2012/0132607 | A1 * | 5/2012 | Landman | B65D 1/023 215/12.1 |
| 2012/0181289 | A1 * | 7/2012 | Apps | B65D 39/086 220/592.19 |
| 2014/0103066 | A1 * | 4/2014 | Geert Norbert | B65D 77/06 222/95 |
| 2015/0108175 | A1 * | 4/2015 | Wauters | B67D 1/125 222/400.7 |

* cited by examiner

CLOSING DEVICE, VALVE UNIT AND CONTAINER

CROSS-REFERENCE TO RELATED APPLICATIONS

This application is a 371 of PCT Application No. PCT/IT2018/050103 filed on Jun. 5, 2018, which claims priority to Italian Application No. 102017000061470 filed on Jun. 6, 2017, the contents of which are hereby incorporated by reference as if recited in their entirety.

FIELD OF THE INVENTION

The present invention concerns a valve unit to control and manage the flow of a fluid entering or leaving a container for a fluid, such as a beverage for example. The invention also concerns a closing device and a container comprising a valve unit according to the invention.

BACKGROUND OF THE INVENTION

Valve units to control and regulate the flow of a fluid are well known in the state of the art. Their use is widespread in many sectors and in many applications where it is necessary to selectively allow and prevent the passage of the fluid under determinate conditions of use.

Containers for fluids are also known, in particular for beverages, comprising valves and closing devices which allow the beverage to come out during a delivery step and allow to close the container in a sealed manner when the delivery of the beverage is not required.

The valves typically comprise a shutter which is kept pressed by a helicoidal spring against an aperture for the passage of the fluid in order to close said aperture. When it is necessary to allow the passage of the fluid, the shutter is distanced from the aperture. The movement of the shutter can be obtained, for example, thanks to the action of a thrust element. Other known components can be associated with the shutter and the spring, necessary for the correct control and functioning of the valves, such as for example sealing elements, damping elements which prevent the helicoidal spring from becoming resonant, etc.

It should also be considered that known valves are typically positioned in dedicated seatings of very small size which are sometimes inconvenient to reach.

Furthermore, since many beverage containers provide to use compressed air, for example to cause the liquid to come out, the valves and closing devices of a known type must provide separate circuits, one for the circulation of the compressed air, and the other for the outflow of the beverage.

It is obvious that a valve unit of this type (and the corresponding closing device) can comprise numerous elements necessary to define the different circuits.

One disadvantage of known solutions is therefore that the valve units are structurally very complicated.

Another disadvantage is that the operations necessary to assemble the valve unit on the container or to disassemble it therefrom can be long and laborious to guarantee the seal.

Examples of solutions known in the state of the art relating to valves associated with closing devices for beverage containers, are described in various prior art patent documents, some of which will be briefly commented on below.

The international patent application WO 00/03944 describes a valve unit for a beverage container of a known type. This solution provides a very complex configuration in which the shutter and the spring acting on it are contained inside a cylindrical element connected to a spacer. The cylindrical element is then slidable inside a guide neck, and is distanced from the latter by a hollow space; the guide neck is connected to the lid of the container. It is obvious that a solution like this is subject to all the disadvantages described above because it comprises many different elements which must cooperate with each other during use, which increases the risk of malfunctions. Moreover, if one element, for example the spring, breaks, a long maintenance intervention is required. Furthermore, the valve unit contains metal components with related problems due to the release of components into the liquid contained. The valve unit described by this document is certainly costly to produce because it includes numerous parts that are mobile with respect to each other. These parts must be made with suitable processes to maintain a good surface finish. Furthermore, for their correct functioning, said components must be subjected to maintenance.

Another example of a container for carbonated beverages known in the state of the art is described in the international patent application WO 2004/101424. In this technical solution, the shutter-spring assembly is contained in a cylindrical body connected to the opening of the container. On one side, a draft pipe is connected to the cylindrical body and reaches the bottom of the tank for the liquid, and on the other side, inside the body, the end of a pin is received which presses on the shutter in contrast with the action of the spring. The pin is connected to an elbow-shaped element which can be moved by the user by driving a lever. The movement of the elbow-shaped element moves the shutter, causing the valve to open or close.

In this case too it is possible to detect a high number of components comprised in the valve, which poses problems of cost. One disadvantage of this solution is that it can be easily subjected to malfunctions because, during use, the outflow of the carbonated beverage can cause the malfunction of one or more elements, such as for example the draft pipe which can become detached.

Furthermore, the container as a whole is cumbersome, complex and expensive.

Another solution known in the state of the art, concerning a container for liquids, is described by the European patent application EP 0389191. This document describes a valve unit comprising two distinct valves, one for the entry of the compressed air necessary to cause the liquid to come out, and the other to control the delivery. The valves have different structures from each other, but they have in common the fact that they are both very complicated, and therefore expensive to produce, laborious to assemble and require maintenance with all the corresponding costs.

Another solution that provides two different valves, one to regulate the passage of the compressed air and the other to regulate the flow of the beverage, is also described by the international patent application WO 2014/081294. The two valves are not adjacent to each other but are disposed at opposite ends of the beverage container.

Other examples of valves for beverage containers are described by the patent documents WO 94/06703, GB 914.091 and US 2008/0061085. In all three cases, these are very complicated valves that comprise a large number of elements.

One purpose of the present invention is to make available an improved valve unit with respect to those known in the state of the art.

Another purpose of the present invention is to make available a closing device and a container for fluids which are perfected with respect to those currently comprised in the state of the art.

Another purpose of the present invention is to provide a valve unit which is simple to construct, and economical both in its construction and in its management.

Another purpose is to provide a valve unit and a closing device having an extremely limited number of components, thus simplifying cleaning and sanitizing interventions.

Another purpose is to provide a closing device which can be assembled to the container, or separated from it, in a simple and rapid manner.

Another purpose is to provide a valve unit and a closing device that are suitable for food use and free of metal parts.

Another purpose is to provide a valve unit and a closing device which allow to define two separate circuits for the passage of the pressurized gas (compressed air) and liquid (beverage), while maintaining simple structures and a reduced number of components.

Another purpose is to make available a beverage container having a closing device able to operate with known beverage delivery means without needing to modify or adapt the solutions already available on the market.

Another purpose is to make available a container having an opening which allows to simplify the internal washing of the container before and after use, if it has to be filled again with a beverage.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

According to the invention, a closing device is provided for a container for fluids, in particular beverages, comprising a valve unit provided with a passage aperture for the fluid and a body, provided with shutter means and mobile with respect to the passage aperture to alternatively define at least a closed configuration in which the shutter means close the passage aperture, and an open configuration, in which the shutter means are distanced from the passage aperture. The closing device according to the invention also comprises a lid disposed to close an opening of the container and comprising holding means disposed to engage with attachment means of the valve unit, so as to allow the connection between the valve unit and the lid.

One peculiarity of the valve unit associable with the closing device according to the invention is that the body comprises elastic means that are integrated in a single body with the shutter means to elastically deform the body between an extended position, in which the shutter means close the passage aperture, and a compressed position, in which the shutter means are distanced from the passage aperture.

One advantage of the closing device according to the invention is that it has a considerably simplified structure with respect to those known in the state of the art, which allows to associate and disconnect the valve unit with/from the lid quickly and simply.

According to the invention, a valve unit is also provided comprising a support element that is connectable to a closing device of a container for fluids. The support element comprises a passage aperture through which the fluid can enter into and exit from said container.

The valve unit according to the invention also comprises a body comprising shutter means that engage with the passage aperture to selectively close the aperture. The body is mobile with respect to the passage aperture so as to define alternatively at least a closed configuration and an open configuration of the valve unit. In the closed configuration the shutter means engage with the passage aperture to prevent the flow of the fluid through it. In the open configuration the shutter means are distanced from the passage aperture and allow the fluid to flow through it.

According to the invention, the valve unit comprises elastic means that are integrated in a single body with the shutter means. The elastic means allow the body to elastically deform between an extended or non-deformed position, in which the valve unit is in said closed configuration, and a compressed or deformed position, in which the valve unit is in said open position.

Thanks to this configuration, the valve unit comprises a single mobile element, which integrates both the shutter function of the passage aperture and the possibility of deforming elastically.

This has the advantage, compared to the known solutions in the state of the art, of being able to eliminate the helicoidal spring that acts on the shutter. The person of skill in the art will understand immediately that this technical solution is very advantageous since it allows to render the valve unit much simpler structurally and therefore much easier and quicker to assemble and dismantle. Moreover, another advantage of the invention is that the valve unit is more economical to produce.

Moreover, the elimination of the helicoidal spring renders the valve unit safer and more reliable since it is a delicate element that can easily be subjected to breakages and malfunctioning, for example because of cracks due to wear.

The body according to the invention also comprises connection means, in particular to make a connection of the mechanical type, between the body and the support element. In this way the body and the support element are joined to each other and can move solidly with each other.

In one embodiment, the connection means can be integrated in a single body together with the shutter means and the elastic means.

This configuration is advantageous because it has the minimum possible number of components of the valve unit.

In one embodiment, the support element and the body are made of the same material, in particular of a plastic material, such as polyethylene terephthalate (PET) for example.

In one embodiment, the support element and the body are made of the same material of which the closing device and the container are made. For example, they can all be made of polyethylene terephthalate (PET), or more generally also with other types of plastic materials.

One advantage of this characteristic is to make the valve unit, the closing device and the container completely recyclable.

Another advantage lies in the fact that in this way any components made of metal material are completely eliminated from the valve unit, the closing device and the container. Thanks to this, any possible contamination of the beverage with ions or particles that could be noxious for the health if swallowed by a human being is avoided.

Another advantage of this characteristic is that it is possible to make the components of the valve unit, the closing device and the container according to known techniques in the sector of working plastic materials, such as injection molding and stretch blow molding, which are more economical and convenient than conventional chip-removal processes needed to work the same components made of metal materials.

Another advantage of a container according to the invention is that it can easily be re-used. This is due to the fact that the container and the closing device have a simple structure that allows to perform the washing operations inside the container easily and quickly. To this end, it should be noted that during the washing operations it is sufficient to turn the container upside down and put its opening on a washing device of the known type, for example provided with an elongated element that extends toward the inside of the container and is provided with a plurality of nozzles from which a washing liquid (for example water, or a mixture of soap and water) can be sprayed against the inner walls of the container.

BRIEF DESCRIPTION OF THE DRAWINGS

These and other characteristics of the present invention will become apparent from the following description of some embodiments, given as a non-restrictive example with reference to the attached drawings wherein.

To facilitate comprehension, the same reference numbers have been used, where possible, to identify identical common elements in the drawings. It is understood that elements and characteristics of one embodiment can conveniently be incorporated into other embodiments without further clarifications.

DETAILED DESCRIPTION OF SOME EMBODIMENTS

We will now refer in detail to the various embodiments of the present invention, of which one or more examples are shown in the attached drawings. Each example is supplied by way of illustration of the invention and shall not be understood as a limitation thereof. For example, the characteristics shown or described insomuch as they are part of one embodiment can be adopted on, or in association with, other embodiments to produce another embodiment. It is understood that the present invention shall include all such modifications and variants.

Figure 1:
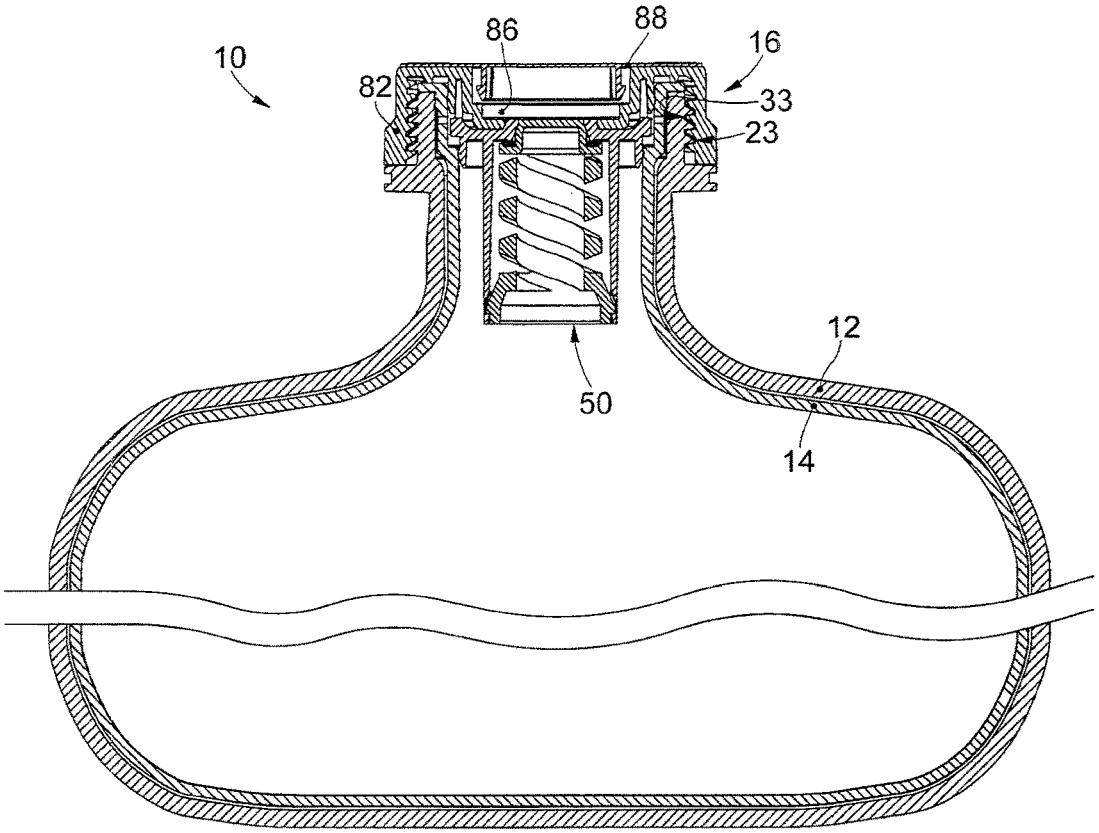
FIG. 1 is a partial cross section of a container for fluids provided with a closing device comprising a valve unit according to the invention.

With reference to FIG. 1, we will now describe a container for fluids, in particular for beverages, indicated by the reference number 10. It should be noted that the container 10 can contain any type of beverage. For example, the container 10 can contain carbonated beverages, such as beer for example.

The container 10 comprises an external keg 12 and an internal bag 14. The internal bag 14 is disposed inside the external keg 12 and is suitable to contain the fluid, that is, the beverage. The internal bag 14 is a flexible container which defines the tank inside which the beverage is stored. The internal bag 14 and the external keg 12 are separated by a hollow space 13 (better seen in FIGS. 3 and 4). The hollow space 13 is disposed to be filled with a pressurized gas such as compressed air for example. The pressurized gas causes the internal bag 14 to be crushed and, consequently, the beverage to come out. To allow compressed air to enter the hollow space 13, the internal bag 14 comprises one or more through holes 15 (also better seen in FIGS. 3 and 4). The assembly formed by the external keg 12 and the internal bag 14 is closed by a closing device 16, which will be described in greater detail below.

Figure 2:
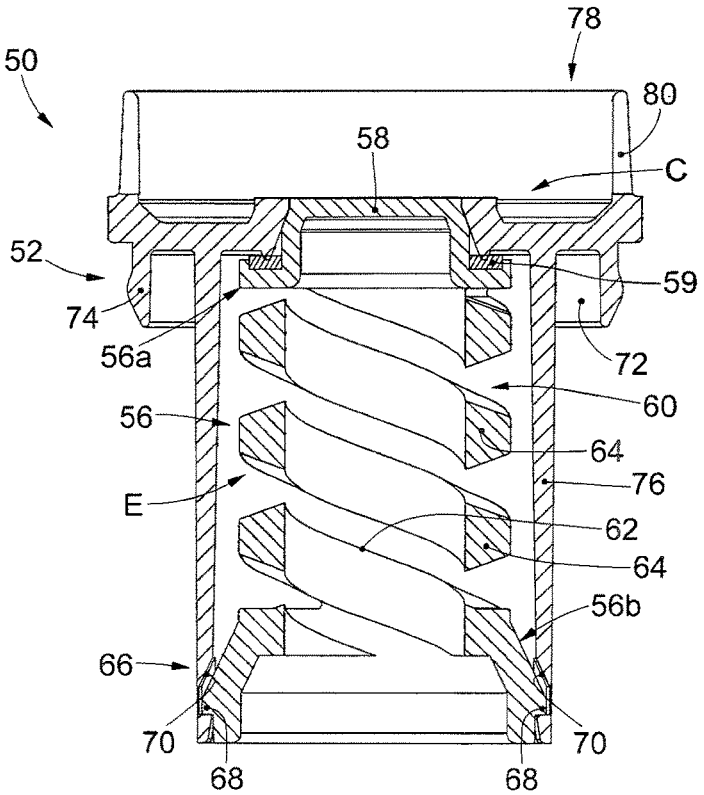
FIG. 2 is an enlarged detail of FIG. 1, which shows the valve unit in a closed configuration.
Figure 4:
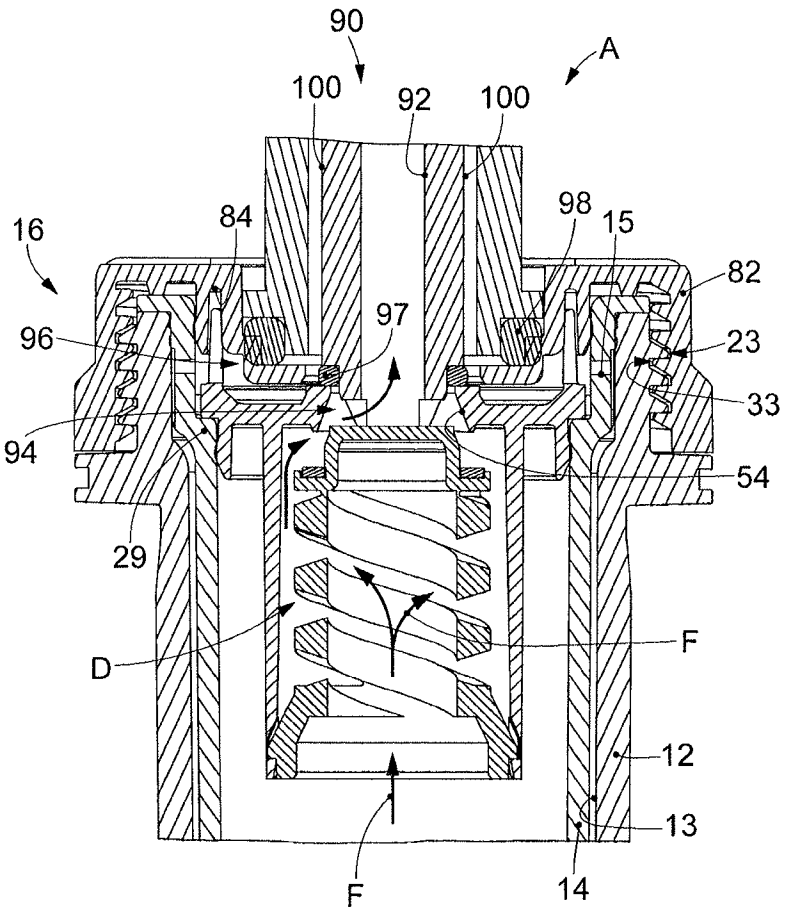
FIGS. 3 and 4 are cross section views of a valve unit according to the invention, shown respectively in a closed configuration and an open configuration, and a closing device comprising the valve unit.
Figure 3:
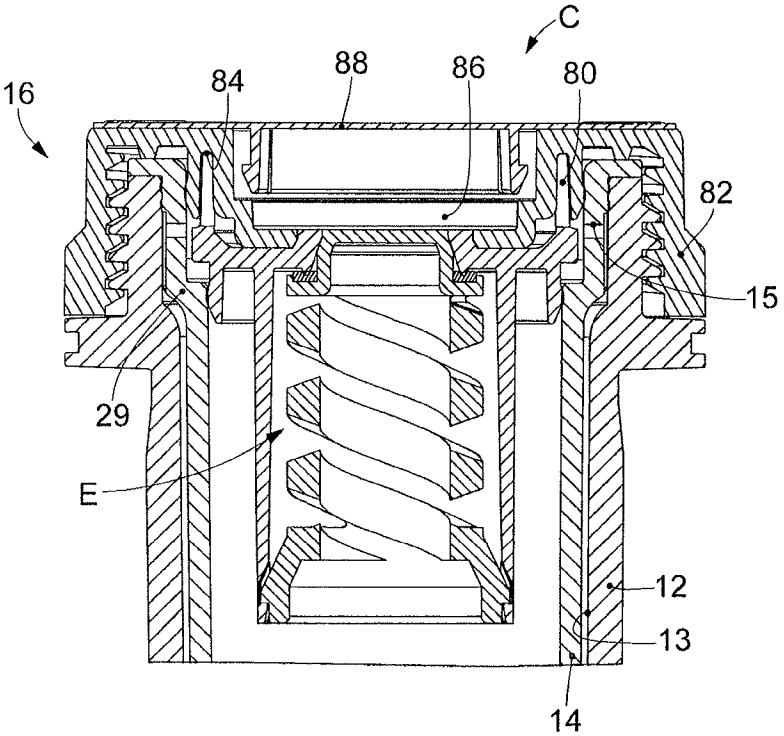

According to the invention, the closing device 16 comprises a valve unit 50, shown in greater detail in FIGS. 2-4.

The valve unit 50 can alternatively assume at least one closed configuration C, shown in FIGS. 1-3, and an open configuration A, shown in FIG. 4. In the closed configuration C, the valve unit 50 is disposed in such a way as to close the container 10 in a sealed manner so that the beverage cannot escape from the internal bag 14. On the contrary, in the open configuration A, the valve unit 50 is disposed so as to allow the fluidic connection between the inside of the container 10 (in particular between the internal bag 14) and the outside. In other words, the container 10 is open and the beverage can be delivered.

The valve unit 50 comprises a support element 52 which is disposed to be attached to the closing device 16. The support element 52 comprises at least one passage aperture 54 (better seen in FIG. 4) through which the fluid (that is, the beverage) can pass, in order to enter into, or exit from, the container 10 (more particularly, from its internal bag 14).

The valve unit 50 comprises a body 56.

The body 56 comprises shutter means 58 disposed to engage with the passage aperture 54 to selectively close said aperture.

The body 56 is mobile with respect to the passage aperture 54 so as to alternatively define the closed and open configurations. In the closed configuration C, the shutter means 58 engage with the passage aperture 54 to prevent the passage of the beverage. In the open configuration A, the shutter means 58 are distanced from the passage aperture 54 and allow the passage of the beverage.

In the embodiment shown, the shutter means 58 are configured as a shutter element with a cylindrical shape. The latter has the shape of a cap and is positioned at a first end 56A of the body 56 which faces toward the passage aperture 54.

In other embodiments, not shown, the shutter means 58 can have a different shape from the one shown in the attached drawings, provided that it is suitable to obstruct the passage aperture 54 in the closed configuration C. In other words, it is sufficient that the shutter means 58 and the passage aperture 54 have an at least partly complementary shape.

It should be noted that a sealing element 59 can be associated with the shutter means 58, for example a packing made of elastomer material.

The body 56 also comprises elastic means 60 which are integrated in a single body with the shutter means 58. The elastic means 60 allow the body 56 to deform elastically between a non-deformed or extended position E, in which the valve unit 50 is in the closed configuration C, and a deformed or compressed position D, in which the valve unit 50 is in the open position A.

In the embodiment shown, the elastic means 60 are configured as a helicoidal spring. The helicoidal spring is obtained by making a helicoidal groove 62 in a wall 64, for example substantially cylindrical, of the body 56.

In one embodiment, the support member 52 and the body 56 are made of the same material. In particular, they can be made of plastic material, for example polyethylene terephthalate (PET).

It should be noted that, in one embodiment, the support element 52 and the body 56 are made of the same material of which the closing device 16 and/or the container 10 are made. For example, they can all be made of plastic material, in particular polyethylene terephthalate (PET).

The body 56 also comprises connection means 66 which connect it to the support element 52. In this way the body 56 and the support element 52 are joined to each other and can move solidly with each other.

In one embodiment, the connection means 66 are positioned in correspondence with a second end 56B of the body 56, opposite the first end 56A.

In one embodiment, the connection means 66 can be integrated in a single body together with the shutter means 58 and the elastic means 60.

In one embodiment, the connection means 66 are disposed to connect the body 56 to the support element 52 by means of a mechanical connection. In this embodiment, the connection means 66 comprise one or more engagement elements 68, which can be configured as fins. The engagement elements are made in a single body with the body 56. Each engagement element 68 is received in a corresponding seating 70 made on the support element 52.

In other embodiments, not shown, the connection means 66 can make other connections of the mechanical type, different from the one described above but all technically equivalent to it. By way of non-restrictive example, the connection means 66 can make a threaded connection, a snap-in connection, or an interference connection.

In other embodiments, not shown, the body 56 and the support element 52 can be connected by other types of connection (other than the mechanical one), for example by means of non-reversible connection means such as welding or gluing.

The support element 52 also comprises a sealing portion 72, for example shaped like an annular lip, which engages in a sealed manner with an internal upper edge 29 of the container 10. In particular, the internal upper edge 29 is an edge of the internal bag 14. In one embodiment, the sealing portion 72 comprises a block 74 which contacts the upper edge 29 and presses against the latter to prevent unwanted leaks of fluid from the internal bag 14.

The support element 52 also comprises a tubular element 76 which projects inside the internal bag 14. The seatings 70 which receive the engagement elements 68 are made on the tubular element 76. The tubular element 76 substantially defines the lateral walls of a chamber inside which the body 56 is received.

Moreover, the support element 52 comprises attachment means 78 which allow to attach the support element 52 simply and quickly to the closing device 16.

In one embodiment, the attachment means 78 comprise an annular protrusion 80.

The closing device 16 comprises a lid 82 which closes the opening of the container 10.

In one embodiment, the lid 82 is screwed onto the container 10. For this purpose, the lid 82 comprises a threaded portion 33 which engages with a respective threaded portion 23 made on the outside of the container 10, in particular on the external keg 12.

Moreover, the lid 82 comprises an annular recess 84 disposed to receive the attachment means 78 (that is, the annular protrusion 80) so as to attach the valve unit 50 to the lid 82. The diameter of the annular recess 84 and its sizes are such as to allow reciprocal coupling with the annular protrusion 80. In use, to assemble the valve unit 50 to the closing device 16 it is sufficient to insert under pressure the annular protrusion 80 inside the annular recess 84.

The lid 82 also defines a cavity 86 which is facing from an opposite side with respect to the opening of a container and, during a delivery step, receives a portion of the delivery device, as shown in FIG. 4.

The closing device 16 comprises a stopper 88 (FIGS. 1 and 3) which closes the cavity 86. The stopper 88 protects the cavity 86 from dirt and impurities to safeguard hygiene and cleanliness.

The functioning of the valve unit 50 according to the invention is briefly described below.

Once the container 10 has been filled with the fluid, for example a carbonated beverage such as beer, it is closed with the closing device 16. The valve unit 50 is disposed in the closed configuration C, as shown in FIGS. 1-3.

When it is desired to deliver the beverage, the stopper 88 is removed from the closing device 16 and a delivery device 90 is inserted into the cavity 86. It should be noted that the delivery device 90 can be a conventional deliverer such as those known in the state of the art and available on the market.

The delivery device 90 comprises an outflow channel 92 through which the beer coming out of the container 10 can reach a container for consumption by the user. The outflow channel 92 faces the passage aperture 54.

The delivery device 90 comprises an end portion 94 which penetrates inside the passage aperture 54. In this manner, the end portion 94 contacts the shutter means 58 and presses on them. Thanks to the thrusting force of the end portion 94, the body 56 is taken into the compressed or deformed position D so that the valve unit 50 assumes the open configuration A shown in FIG. 4. In this configuration, the beverage can exit from the container 10, passing in succession through the body 56 (in particular, through the helicoidal groove 62) and the passage aperture 54 toward the outflow channel 92, following the path indicated by the arrows F in FIG. 4.

It should be noted that the thrust exerted by the delivery device 90 causes the displacement of the support element 52. The displacement of the support element 52 ends when it comes into abutment with a shoulder which is defined by the upper edge 29 of the internal bag 14. Then the delivery device 90 takes the support element 52 into the end-of-travel position shown in FIG. 4.

The delivery device 90 can also comprise sealing means 96 which have a dual function. Firstly, the sealing means 96 prevent the beverage from dispersing outside the container 10 in its passage between the passage aperture 54 and the outflow channel 92. Secondly, the sealing means 96 isolate the passage path of the compressed air both from inside the container and also from the external environment.

The sealing means 96 therefore comprises a first sealing element 97, for example an O-ring, which surrounds the end portion 94 externally. The first sealing element 97 therefore prevents the dispersion of the beverage exiting from the container 10 outside the outflow channel 92.

The sealing means 96 also comprise a second sealing element 98 disposed to prevent the exit of the air under pressure toward the external environment.

The delivery device 90 comprises a plurality of supply pipes 100 which carry a pressurized gas, for example compressed air, toward the container 10. The supply pipes 100 lead to the cavity 86. From here the pressurized gas can then reach the hollow space 13. For this purpose, the annular protrusion 80 must comprise one or more passage gaps (not shown) which the compressed air passes through in the path between the cavity 86 and the hollow space 13. During use, the compressed air passes through the supply pipes 100, passes through the cavity 86, the annular protrusion 80, and enters the hollow space 13 through the through holes 15. It should be noted that this path is delimited in a sealed manner by the first and second sealing elements 97, 98.

It is clear that modifications and/or additions of parts can be made to the valve unit and/or closing device and/or container as described heretofore, without departing from the field and scope of the present invention.

It is also clear that, although the present invention has been described with reference to some specific examples, a person of skill in the art shall certainly be able to achieve many other equivalent forms of valve units and/or closing devices and/or containers, having the characteristics as set forth in the claims and hence all coming within the field of protection defined thereby.

The invention claimed is:

1. Closing device for a container for fluids, comprising:

a valve unit comprising:

a support element provided with a passage aperture for the fluid entering into and exiting from said container and a body, provided with shutter means disposed to engage with said passage aperture, and mobile with respect to said passage aperture to alternatively define at least a closed configuration and an open configuration of said valve unit, wherein said shutter means and said passage aperture have an at least partly complementary shape, said body also comprising elastic means that are integrated in a single body with said shutter means to elastically deform said body between an extended position, in which said shutter means close said passage aperture in an at least partly complementary manner and form a seal, and a compressed position, in which said shutter means are distanced from said passage aperture; and a lid disposed to close an opening of said container, and comprising holding means disposed to engage with attachment means of said support element, so as to allow the connection between said valve unit and said lid, wherein said body comprises connection means configured to attach said body to said support element so that said support element moves away from the lid when said elastic means are in the compressed position.

2. Closing device as in claim 1, wherein said lid defines a cavity facing from an opposite part with respect to said opening that is configured to receive a portion of a fluid delivery device; said lid comprising a cap that closes said cavity to protect it from dirt and impurities.

3. Closing device as in claim 1, wherein said lid comprises a threaded portion that engages with a respective threaded portion made on the outside of said container so that said lid can be screwed on said container.

4. Closing device as in claim 1, wherein said holding means are configured as an annular hollow and said attachment means are configured as an annular protrusion that can be inserted under pressure inside said annular hollow.

5. Container for fluids comprising an external keg and an internal bag disposed internally to the external keg and suitable to contain a fluid; said container comprising said closing device as in claim 1.

6. Container as in claim 5, wherein said container and said closing device are made of plastic material as polyethylene terephthalate (PET).

7. Valve unit associable with a closing device of a container for fluids, comprising:

a support element that is disposed to be attached to a closing device of a container for fluids and that comprises at least a passage aperture through which the fluid can enter into or exit from said container, and a body comprising shutter means disposed to engage with said passage aperture to selectively close said passage aperture, wherein said shutter means and said passage aperture have an at least partly complementary shape, said body being mobile with respect to said passage aperture so as to define at least a closed configuration of said valve unit, wherein said shutter means engage with said passage aperture in an at least partly complementary manner and form a seal to prevent the passage of the fluid through it, and an open configuration of said valve unit in which said shutter means are distanced from said passage aperture to allow the passage of the fluid through it, wherein said body comprises elastic means that are integrated in a single body with said shutter means to elastically deform said body between an extended position, in which said valve unit is in said closed configuration, and a compressed position, in which said valve unit is in said open position, wherein said body comprises connection means configured to attach said body to said support element so that said support element moves away from the lid when said elastic means are in the compressed position.

8. Valve unit as in claim 7, wherein said connection means are integrated in a single body together with said shutter means and said elastic means.

9. Valve unit as in claim 7, wherein said support element comprises a sealing portion that is disposed to engage in a sealed manner with an upper edge of said container.

10. Valve unit as in claim 7, wherein said support element comprises attachment means that allow to attach said support element to said closing device.

11. Valve unit as in claim 7, wherein said support element and said body are made of a plastic material as polyethylene terephthalate (PET).

* * * * *